US012600586B2

(12) United States Patent
Tokoro et al.

(10) Patent No.: US 12,600,586 B2
(45) Date of Patent: Apr. 14, 2026

(54) DOCUMENT SHEET CONVEYING DEVICE, IMAGE READING APPARATUS, AND MULTIFUNCTION PERIPHERAL CAPABLE OF HOUSING DISCHARGE TRAY

(71) Applicant: KYOCERA Document Solutions Inc., Osaka (JP)

(72) Inventors: Yoshitaka Tokoro, Osaka (JP); Takafumi Nakagawa, Osaka (JP); Hirofumi Hagihara, Osaka (JP); Ren Isoda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 215 days.

(21) Appl. No.: 18/324,768

(22) Filed: May 26, 2023

(65) Prior Publication Data

US 2023/0382674 A1 Nov. 30, 2023

(30) Foreign Application Priority Data

May 27, 2022 (JP) ..... 2022-086672

(51) Int. Cl.
*B65H 5/26* (2006.01)
*B65H 31/24* (2006.01)

(52) U.S. Cl.
CPC ..... *B65H 5/26* (2013.01); *B65H 31/24* (2013.01); *B65H 2405/1117* (2013.01); *B65H 2801/06* (2013.01)

(58) Field of Classification Search
CPC ..... B65H 2405/1117; B65H 2405/324; B65H 29/58
See application file for complete search history.

(56) References Cited

U.S. PATENT DOCUMENTS 8,038,143 B2 * 10/2011 Watanabe ..... H04N 1/00663 271/3.14
10,301,139 B2 * 5/2019 Kaneko ..... B65H 31/20
10,464,771 B2 * 11/2019 Liao ..... B65H 43/00
2021/0029260 A1 * 1/2021 Shimazu ..... H04N 1/00543
2021/0101769 A1 * 4/2021 Kawasaki ..... B65H 31/24

FOREIGN PATENT DOCUMENTS

JP H10126567 A 5/1998
JP 2021059399 A * 4/2021

* cited by examiner

*Primary Examiner* — Howard J Sanders
(74) *Attorney, Agent, or Firm* — Alleman Hall LLP

(57) ABSTRACT

The document sheet conveying device includes a second discharge tray, and a switching portion. The second discharge tray rotates between a use posture which allows loading of a document sheet on the second discharge tray and a storage posture in which the second discharge tray serves as a part of the conveyance housing. The switching portion connects a first conveying path formed from a supply tray to a branch point inside the conveyance housing to one of a second conveying path formed from the branch point to a first discharge tray and a third conveying path formed from the branch point to the second discharge tray. The switching portion connects the first conveying path to the third conveying path when the posture of the second discharge tray has been changed to the use posture in a state where the first conveying path is connected to the second conveying path.

8 Claims, 7 Drawing Sheets

DOCUMENT SHEET CONVEYING DEVICE, IMAGE READING APPARATUS, AND MULTIFUNCTION PERIPHERAL CAPABLE OF HOUSING DISCHARGE TRAY

INCORPORATION BY REFERENCE

This application is based upon and claims the benefit of priority from the corresponding Japanese Patent Application No. 2022-086672 filed on May 27, 2022, the entire contents of which are incorporated herein by reference.

BACKGROUND

The present disclosure relates to a document sheet conveying device, an image reading apparatus, and a multifunction peripheral which convey a document sheet.

For example, a conventional printing apparatus with a double-sided image reading function includes a hopper for setting a read medium, two upper and lower stackers, a first conveying path extending linearly from the hopper to the upper stacker, and a second conveying path branching off from the first conveying path and extending to the lower stacker. When an image on one side of the read medium is read, the read medium is conveyed from the hopper along the first conveying path and discharged to the upper stacker. When images on both sides of the read medium are read, the read medium is conveyed from the hopper along the first conveying path, switched to the second conveying path by a switching blade at a branch point, switched back, conveyed along the second conveying path, and discharged to the stacker below.

SUMMARY

A document sheet conveying device according to the present disclosure includes a supply tray, a first discharge tray, a second discharge tray, a detection portion, a first conveying path, a second conveying path, a third conveying path, and a switching portion. The supply tray extends outward from a conveyance housing. The first discharge tray is provided below the supply tray. The second discharge tray is provided on an opposite side of the supply tray across the conveyance housing and rotates between a use posture which allows loading of a document sheet on the second discharge tray and a storage posture in which the second discharge tray serves as a part of the conveyance housing. The detection portion detects a posture of the second discharge tray. The first conveying path is formed linearly from the supply tray to a branch point inside the conveyance housing. The second conveying path is formed in a U-shape from the branch point to the first discharge tray. The third conveying path is formed linearly from the branch point to the second discharge tray. The switching portion is provided at the branch point and connects the first conveying path to one of the second conveying path and the third conveying path. In addition, the switching portion connects the first conveying path to the third conveying path when the detection portion detects that the posture of the second discharge tray has been changed from the storage posture to the use posture in a state where the first conveying path is connected to the second conveying path.

An image reading apparatus according to the present disclosure includes the document sheet conveying device and two or more reading portions. The two or more reading portions read an image of the document sheet conveyed along at least the second conveying path and the third conveying path.

A multifunction peripheral according to the present disclosure includes the image reading apparatus and an image forming apparatus. The image forming apparatus forms an image on a medium.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
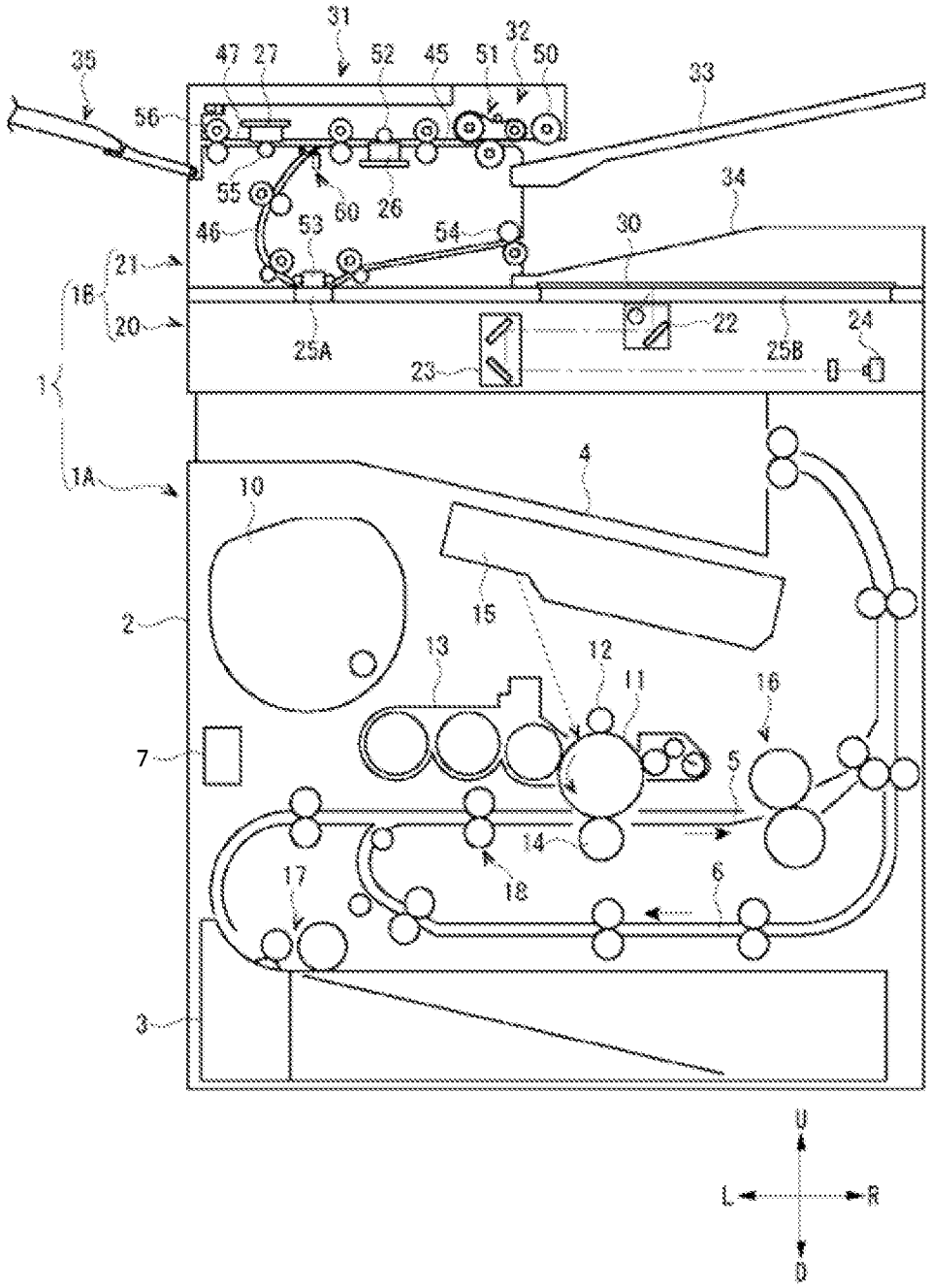
FIG. 1 is a schematic diagram (front view) showing an internal structure of a multifunction peripheral according to an embodiment of the present disclosure.

Hereinafter, embodiments of the present disclosure will be described with reference to the accompanying drawings. It is noted that Fr, Rr, L, R, U, and D shown in the drawings indicate front, rear, left, right, up, and down. Although terms indicating directions and positions are used herein, such terms are used for convenience of description and do not limit the technical scope of the present disclosure.

[Multifunction Peripheral]

A multifunction peripheral 1 will be described with reference to FIG. 1. FIG. 1 is a schematic diagram (front view) showing an internal structure of the multifunction peripheral 1.

The multifunction peripheral 1 includes an image forming apparatus 1A that forms an image on a sheet (medium (not shown)) by an electrophotographic method, and an image reading apparatus 1B that optically reads an image of a document sheet.

[Image Forming Apparatus]

As shown in FIG. 1, the image forming apparatus 1A includes an apparatus main body 2, which constitutes a substantially rectangular parallelepiped exterior. A sheet feed cassette 3 for housing sheets is detachably provided in a lower portion of the apparatus main body 2, and a sheet discharge tray 4 is provided on an upper surface of the apparatus main body 2. In addition, the image forming apparatus 1A includes a toner container 10, a photoconductor drum 11, a charging device 12, a developing device 13, a transfer roller 14, a laser scanning unit 15, and a fixing device 16.

The toner container 10 is disposed in an upper left portion of the apparatus main body 2 and stores, for example, black toner (developer). The photoconductor drum 11 is provided on a midstream part of a first conveying path 5 extending from the sheet feed cassette 3 to the sheet discharge tray 4. The charging device 12, the developing device 13, and the transfer roller 14 are disposed around the photoconductor drum 11 in image forming processing order. The transfer roller 14 contacts the photoconductor drum 11 from below to form a transfer nip. The laser scanning unit 15 is provided above the photoconductor drum 11. The fixing device 16 is provided on a downstream part of the first conveying path 5.

A sheet feed portion 17 is provided at an upstream end of the first conveying path 5, and a registration roller pair 18 is provided on a midstream part of the first conveying path 5. Inside the apparatus main body 2, there is provided a second conveying path 6 which branches off from a downstream part of the first conveying path 5 and joins an upstream part of the first conveying path 5. It is noted that the first conveying path 5 and the second conveying path 6 are provided with a plurality of conveying roller pairs for conveying sheets.

The multifunction peripheral 1 is provided with a control device 7 for controlling various control target devices as appropriate. The control device 7 includes a processor or the like that executes various kinds of arithmetic processing in accordance with programs and parameters stored in a memory. In addition, the multifunction peripheral 1 is provided with a display input portion such as a touch panel or buttons (not shown) for inputting various instructions from the user (operator). The display input portion is electrically connected to the control device 7, and transmits an input signal to the control device 7 and receives an electric signal (for example, display information to the touch panel) from the control device 7.

[Image Forming Processing]

An operation of the image forming apparatus 1A will be described. The control device 7 executes image forming processing as follows based on, for example, image data input from an external terminal.

The charging device 12 charges the surface of the photoconductor drum 11, and the laser scanning unit 15 emits scanning light based on the image data to form an electrostatic latent image on the surface of the photoconductor drum 11. The developing device 13 develops a toner image on the surface of the photoconductor drum 11 using toner supplied from the toner container 10. The sheet feed portion 17 feeds sheets from the sheet feed cassette 3 one by one to the first conveying path 5. The sheet is conveyed along the first conveying path 5, is skew-corrected by the registration roller pair 18, and enters the transfer nip. The transfer roller 14 transfers the toner image on the photoconductor drum 11 onto the sheet passing the transfer nip, and the fixing device 16 thermally fixes the toner image on the sheet. In the case of single-sided printing, the sheet is discharged to the sheet discharge tray 4.

In the case of double-sided printing, the sheet is switched back at a downstream end of the first conveying path 5, conveyed along the second conveying path 6, and returned to the first conveying path 5. Thereafter, an image is formed on the back side of the sheet through the same processing as above, and the double-sided printed sheet is discharged to the sheet discharge tray 4.

[Image Reading Apparatus]

As shown in FIG. 1, the image reading apparatus 1B includes a reading device 20 and a document sheet conveying device 21. The reading device 20 is attached to the upper surface of the apparatus main body 2, and is disposed above the sheet discharge tray 4 with a sheet discharge space therebetween. The document sheet conveying device 21 is attached to the upper surface of the reading device 20.

<Reading Device>

The reading device 20 includes a laser scanning unit 22, a reflection unit 23, and an image sensor 24. The laser scanning unit 22 applies light onto a document sheet placed on a contact glass 25A or a platen glass 25B. The reflection unit 23 reflects the light reflected from the document sheet toward the image sensor 24. When a document sheet on the platen glass 25B is read, the laser scanning unit 22 and the reflection unit 23 move so that the optical path length from the document sheet to the image sensor 24 is constant. The image sensor 24 as an example of the reading portion photoelectrically converts the input light.

In addition, the reading device 20 includes a first reading portion 26 and a second reading portion 27. The first reading portion 26 and the second reading portion 27, which are examples of the reading portion, are provided inside a conveyance housing 31 of the document sheet conveying device 21, which will be described later, and have the same function as the image sensor 24 described above.

By the way, a conventional printing apparatus with a double-sided image reading function includes a hopper for setting a read medium, two upper and lower stackers, a first conveying path extending linearly from the hopper to the upper stacker, and a second conveying path branching off from the first conveying path and extending to the lower stacker. When an image on one side of a read medium is read, the read medium is conveyed from the hopper along the first conveying path and discharged to the upper stacker. When images on both sides of the read medium are read, the read medium is conveyed from the hopper along the first conveying path, switched to the second conveying path by a switching blade at a branch point, switched back, conveyed along the second conveying path, and discharged to the lower stacker.

However, in the above-described technique, two stackers are permanently provided and cannot be folded; therefore, there is a problem that the stackers become an obstacle when the stackers are not used, and space saving of the apparatus cannot be achieved. In addition, the switching between the conveying paths by the switching blade requires the user to perform an operation of selecting a reading mode, and the user cannot easily and intuitively perform the operation of switching between the conveying paths.

On the other hand, as will be described below, the document sheet conveying device 21 according to the embodiment of the present disclosure can house the second discharge tray 35, and can switch the path in conjunction with the use of the second discharge tray 35.

<Document Sheet Conveying Device>

Figure 2:
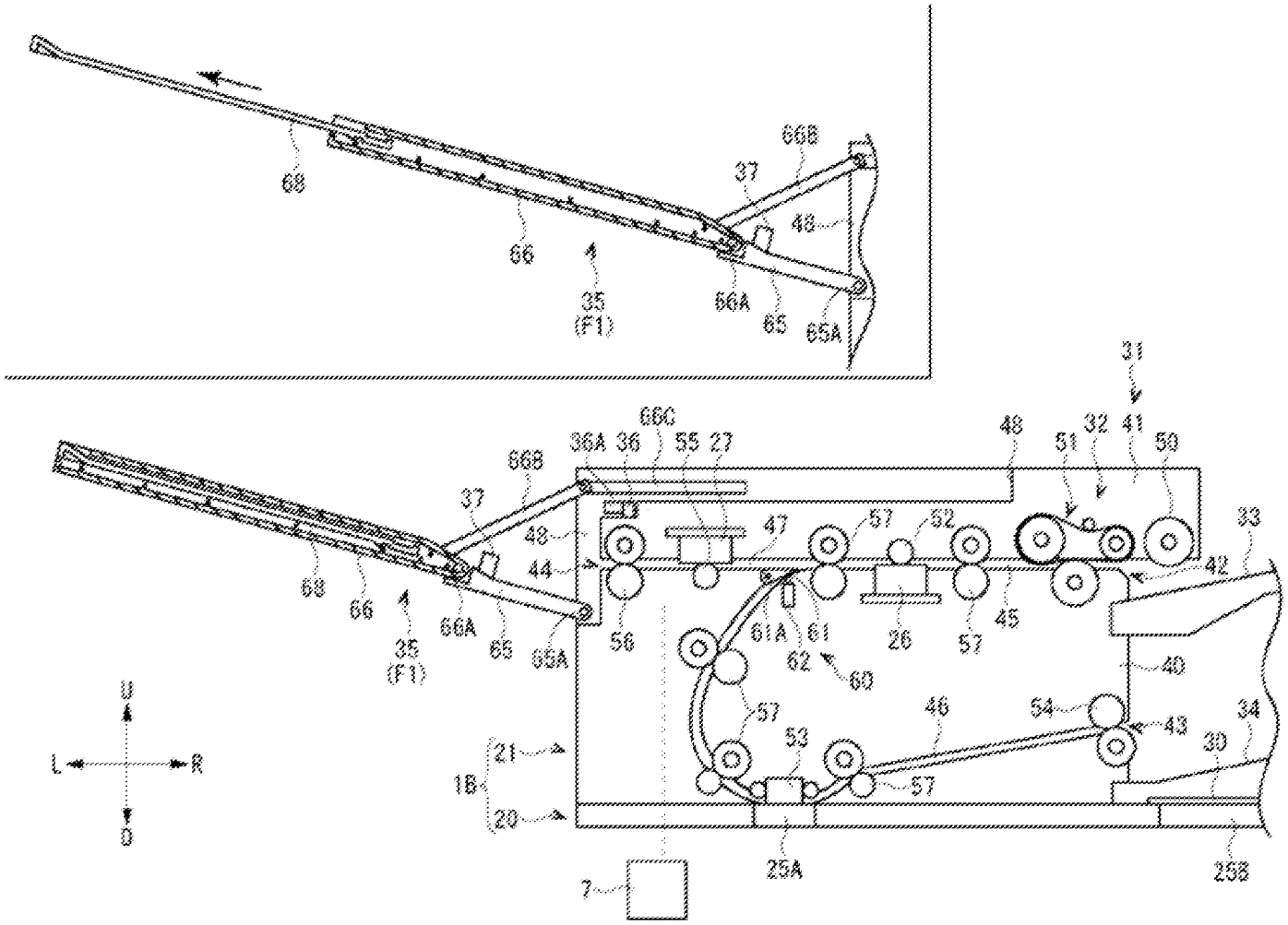
FIG. 2 is a schematic diagram (front view) showing an internal structure of a document sheet conveying device according to an embodiment of the present disclosure.
Figure 3:
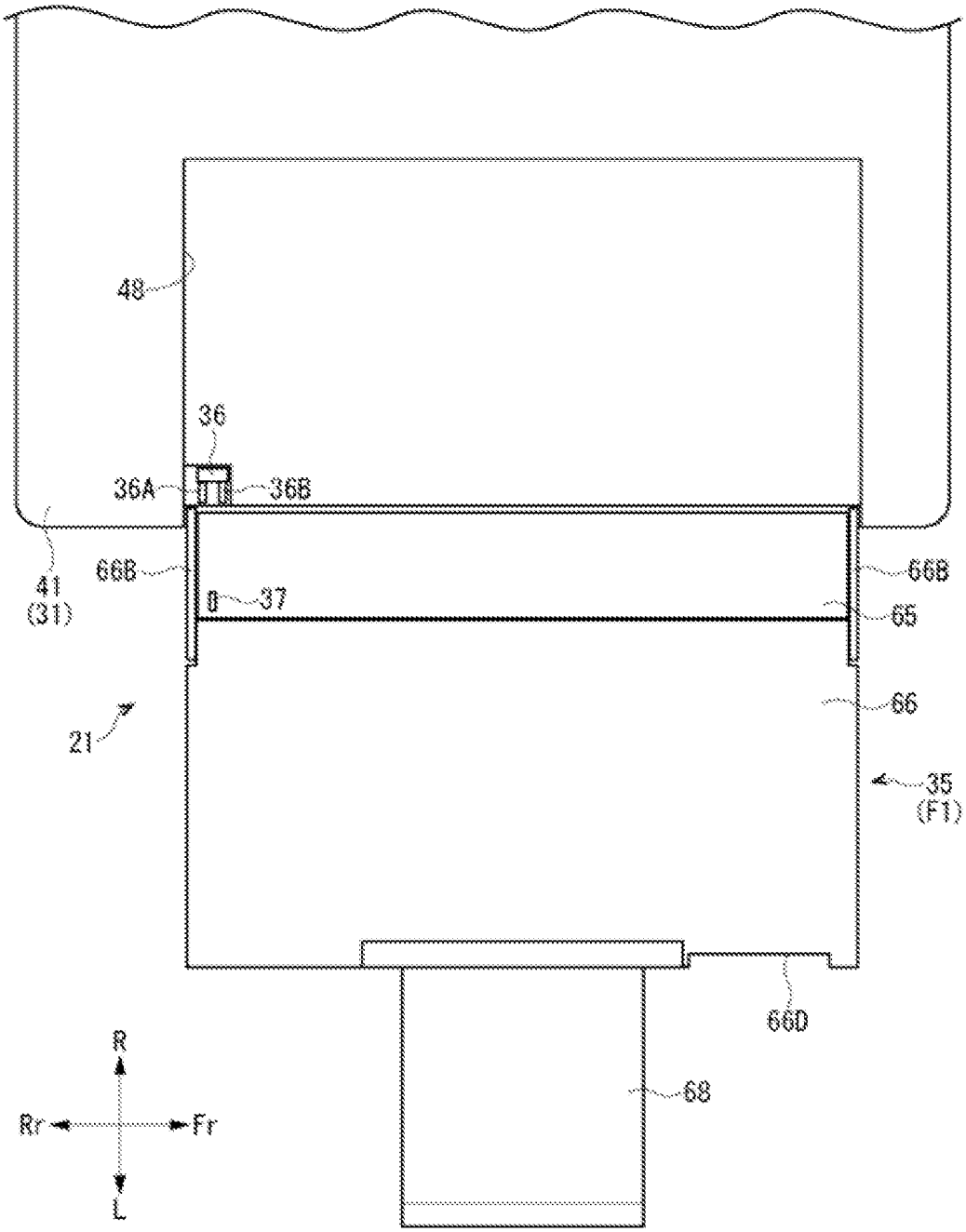
FIG. 3 is a plan view showing a second discharge tray in a use posture in the document sheet conveying device according to an embodiment of the present disclosure.
Figure 4:
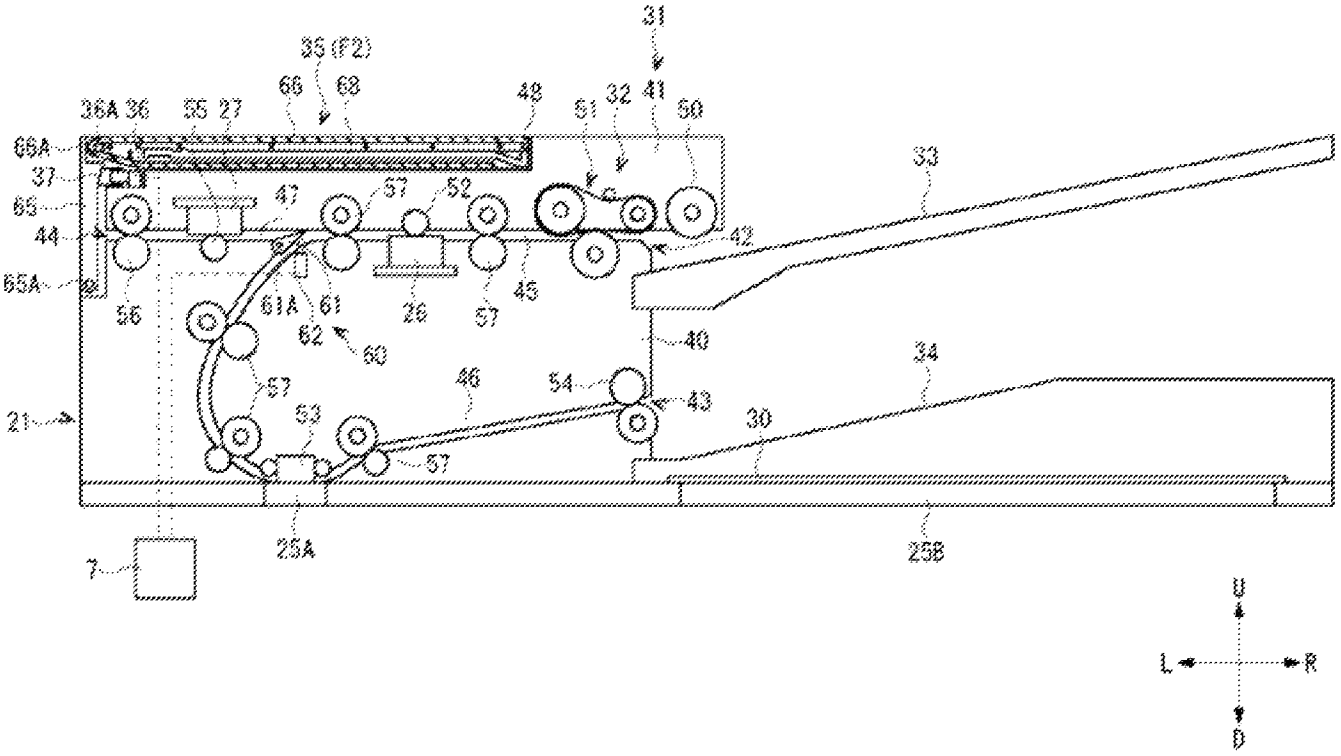
FIG. 4 is a schematic view (front view) showing the second discharge tray in a storage posture in the document sheet conveying device according to an embodiment of the present disclosure.
Figure 5:
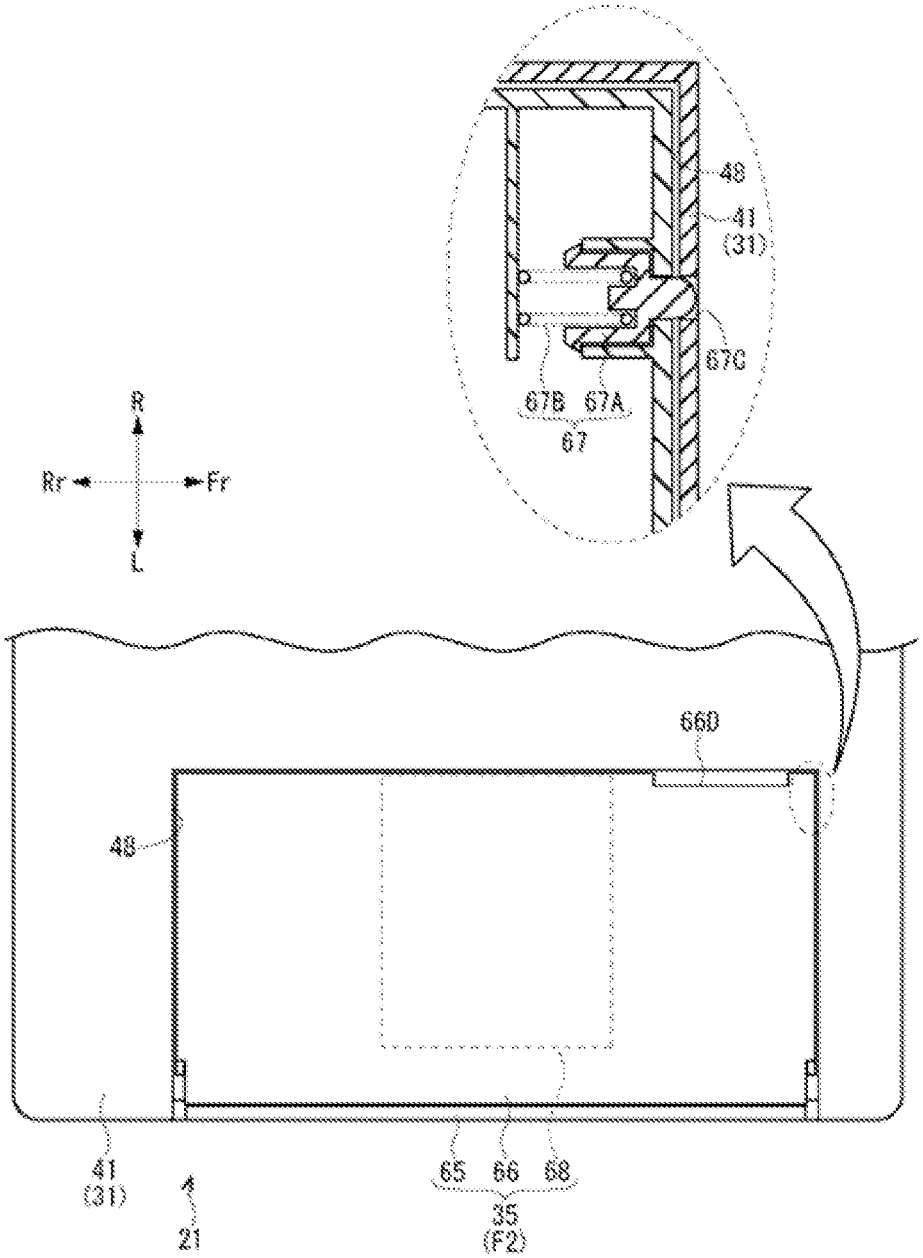
FIG. 5 is a plan view showing the second discharge tray in the storage posture in the document sheet conveying device according to an embodiment of the present disclosure.

The document sheet conveying device 21 will be described in detail with reference to FIG. 1 to FIG. 5. FIG. 2 is a schematic diagram (front view) showing an internal structure of the document sheet conveying device 21. FIG. 3 is a plan view showing the second discharge tray 35 in a use posture F1. FIG. 4 is a schematic view (front view)

showing the second discharge tray 35 in a storage posture F2. FIG. 5 is a plan view showing the second discharge tray 35 in the storage posture F2.

As shown in FIG. 1 and FIG. 2, the document sheet conveying device 21 includes a document sheet holding portion 30, a conveyance housing 31, a conveying mechanism portion 32, a supply tray 33, a first discharge tray 34, and a second discharge tray 35. It is noted that, in the description of the image reading apparatus 1B, the direction in which the document sheet is conveyed will be referred to as a "conveying direction", and the terms "upstream" and "downstream" and similar terms refer to the "upstream" and "downstream" in the conveying direction and similar concepts.

The document sheet holding portion 30 is rotatably (openably and closably) attached to a rear portion of the upper surface of the reading device 20 via a hinge (not shown). The conveyance housing 31 is formed in a substantially rectangular parallelepiped shape, and is disposed on a substantially left half of the document sheet holding portion 30. The conveying mechanism portion 32 is built in the conveyance housing 31. The supply tray 33 extends obliquely upward from (the upper right portion of) the conveyance housing 31 toward the outside (toward the right). The first discharge tray 34 is provided on the upper surface of the document sheet holding portion 30, that is, below the supply tray 33. The second discharge tray 35 is provided on the opposite side of the supply tray 33 across the conveyance housing 31, that is, on an upper left portion of the conveyance housing 31. A document sheet whose image is to be read is set on the supply tray 33, and a document sheet whose image has been read is discharged (loaded) on the first discharge tray 34 or the second discharge tray 35.

(Conveyance Housing)

As shown in FIG. 2, the conveyance housing 31 includes a support portion 40 and a cover 41. The support portion 40 constitutes a path for conveying the document sheet and supports the conveying mechanism portion 32. The cover 41 constitutes an upper and left exterior of the support portion 40. A supply port 42 and a first discharge port 43 are formed in the right side surface of the conveyance housing 31, and a second discharge port 44 (discharge port) is formed in the left side surface of the conveyance housing 31 (cover 41). The supply port 42 is open between the support portion 40 and the cover 41, and the first discharge port 43 is open below the supply port 42. The second discharge port 44 is open at substantially the same height as the supply port 42.

(First to Third Conveying Paths)

A first conveying path 45, a second conveying path 46, and a third conveying path 47, which serve as paths for conveying the document sheet, are formed in the support portion 40 (inside the conveyance housing 31).

The first conveying path 45 extends substantially horizontally from the supply port 42 toward the left (the second discharge tray 35). The first conveying path 45 is linearly formed from the supply tray 33 (supply port 42) to a branch point between the second conveying path 46 and the third conveying path 47. The second conveying path 46 branches at the branch point, is directed to the right while curving downward in an arc shape, and extends obliquely upward toward the first discharge port 43. The second conveying path 46 is generally formed in a U-shape between the branch point and the first discharge tray 34.

The third conveying path 47 extends substantially horizontally toward the left (the second discharge tray 35) as an extension of the first conveying path 45. The third conveying path 47 is formed linearly from the branch point to the second discharge tray 35. The third conveying path 47 and the first conveying path 45 form a substantially linear path. The "linear" shape includes a shape which does not curve or bend the document sheet, and refers to a shape capable of conveying without resistance (without curving or bending) small-sized document sheets such as a business card and a postcard, large-weight document sheets, and special document sheets such as a card made of synthetic resin.

(Cover)

The cover 41 is disposed so as to cover the upper side and left side of the support portion 40. The cover 41 is supported rotatably on a lower left corner of the support portion 40 (not shown). When the cover 41 is rotated so that it flips up, the first conveying path 45, the third conveying path 47, and the like are opened (not shown) to allow jammed document sheets to be removed.

As shown in FIG. 2, a tray housing portion 48 is formed in the cover 41 so as to be recessed by one step from the surface (exposed surface). The tray housing portion 48 is recessed from the upper side of the left side surface to the left side of the top surface of the cover 41. The tray housing portion 48 formed in the top surface of the cover 41 is larger (wider) than the tray housing portion 48 formed in the left side surface of the cover 41 (see also FIG. 3). Although details will be described later, the second discharge tray 35 is housed (fitted) in the tray housing portion 48. It is noted that the above-described second discharge port 44 is open in the range of the tray housing portion 48.

(Conveying Mechanism Portion)

As shown in FIG. 1 and FIG. 2, the conveying mechanism portion 32 includes a pickup roller 50, a separation unit 51, a first correction roller 52, a correction portion 53, a first discharge roller pair 54, a second correction roller 55, a second discharge roller pair 56, and a switching portion 60. It is noted that a plurality of document sheet conveying roller pairs 57 are provided at appropriate positions on the first to third conveying paths 45 to 47 (see FIG. 2). The first discharge roller pair 54, the second discharge roller pair 56, and the document sheet conveying roller pairs 57 convey the document sheet by rotating while nipping the document sheet. In addition, the document sheet conveying roller pairs 57 provided on the first conveying path 45 and the third conveying path 47 are arranged at intervals shorter than the length of the minimum size document sheet (for example, a business card or the like) that can be conveyed.

(Structures Arranged on First Conveying Path)

The pickup roller 50, the separation unit 51, and the first correction roller 52 are provided in this order from the upstream side to the downstream side of the first conveying path 45. The separation unit 51 includes a belt hung on two pulleys and a separation roller in contact with the belt. The first correction roller 52 has a reflective surface that performs shading correction, and is disposed on the upper side of the first conveying path 45. The above-described first reading portion 26 is disposed so as to face the first correction roller 52 from below.

(Structures Arranged on Second Conveying Path)

The correction portion 53 is a reflector that performs shading correction, and is disposed on the contact glass 25A on the second conveying path 46. The first discharge roller pair 54 is provided at a downstream end of the second conveying path 46 (near the first discharge port 43).

(Structures Arranged on Third Conveying Path)

The second correction roller 55 has a reflective surface that performs shading correction, and is disposed on the lower side of the third conveying path 47. The above-described second reading portion 27 is disposed so as to face the second correction roller 55 from above. The second discharge roller pair 56 is provided at a downstream end of the third conveying path 47 (near the second discharge port 44).

(Switching Portion)

The switching portion 60 is provided at a branch point between the second conveying path 46 and the third conveying path 47. The switching portion 60 connects the first conveying path 45 to either the second conveying path 46 or the third conveying path 47, and guides the document sheet to either the second conveying path 46 or the third conveying path 47. The switching portion 60 includes a guide plate 61 rotatably supported by the support portion 40, and a drive source 62 that swings the guide plate 61.

The guide plate 61 is formed in a claw shape that tapers from a swing shaft 61A toward the tip. The guide plate 61 is disposed in a posture in which the tip of the claw shape is directed to the upstream side in the conveying direction, and swings in the up-down direction around the swing shaft 61A. The drive source 62 is a so-called pull-type solenoid, and is disposed in a rear portion (or front portion) of the conveyance housing 31 so as not to interfere with the conveyed document sheet. The tip of the plunger of the drive source 62 is coupled to the lower surface of the guide plate 61. In addition, the drive source 62 is electrically connected to the control device 7, and is driven and controlled by the control device 7. It is noted that the control device 7 is a structure of the multifunction peripheral 1, but also is a structure of the image reading apparatus 1B or the document sheet conveying device 21. In addition, the control device 7 may be regarded as a part of the switching portion 60.

In a state where the drive source 62 is not energized, the plunger is pushed out, and the guide plate 61 is placed in an inclined posture in which the tip is directed upward to close the third conveying path 47, thereby connecting the first conveying path 45 to the second conveying path 46 (see FIG. 4). That is, the switching portion 60 guides the document sheet from the first conveying path 45 to the second conveying path 46. On the other hand, in a state where the drive source 62 is energized, the plunger is sucked, and the guide plate 61 is placed in a substantially horizontal posture to close the second conveying path 46, thereby connecting the first conveying path 45 to the third conveying path 47 (see FIG. 2). That is, the switching portion 60 guides the document sheet from the first conveying path 45 to the third conveying path 47. It is noted that the drive source 62 may be a so-called push-type solenoid, in which case, the control is the reverse of the energization control described above.

It is noted that the document sheet guided from the first conveying path 45 to the second conveying path 46 is limited to documents that can be conveyed while being curved, such as copy paper. On the other hand, the document sheet guided from the first conveying path 45 to the third conveying path 47 is not limited to copy paper or the like, and may be special documents such as a card. That is, the first conveying path 45 and the second conveying path 46 are paths for conveying documents that can be curved, and the first conveying path 45 and the third conveying path 47 are paths capable of conveying even documents that cannot be curved.

(Second Discharge Tray)

As shown in FIG. 2 and FIG. 3, the second discharge tray 35 includes a linkage portion 65, a tray main body 66, and an extension portion 68. The second discharge tray 35 is generally formed in a substantially rectangular plate shape (see FIG. 3).

(Linkage Portion)

The linkage portion 65 is formed in a rectangular plate shape which can be fitted into the tray housing portion 48 formed in the left side surface of the cover 41. A pair of first rotation shafts 65A are fixed to both front and rear end surfaces of a proximal end portion (root portion) of the linkage portion 65. The pair of first rotation shafts 65A are inserted into a pair of recesses (not shown) formed in the inner surfaces on the front and rear sides of the tray housing portion 48. The linkage portion 65 is rotatably connected to the conveyance housing 31 via the first rotation shafts 65A.

(Tray Main Body)

The tray main body 66 is formed in a rectangular plate shape which can be fitted into the tray housing portion 48 formed in the top surface of the cover 41. The tray main body 66 is hollow. The tray main body 66 (the proximal end portion thereof) is rotatably connected to a distal end portion of the linkage portion 65 via a second rotation shaft 66A. In addition, both ends of a pair of arm portions 66B are rotatably connected to the front and rear sides of the tray main body 66 and the front and rear inner side surfaces of the tray housing portion 48. In addition, each arm portion 66B is slidably provided along a slide rail 66C (see FIG. 2) formed on the inner side surface of the tray housing portion 48.

As shown in FIG. 3 and FIG. 5, a handle portion 66D, which catches a hand of a user (operator), is recessed in the distal end portion of the tray main body 66. In addition, as shown in FIG. 5, an engagement portion 67 for keeping the tray main body 66 housed in the tray housing portion 48 is provided on the front side of the distal end of the tray main body 66. The engagement portion 67 includes a protruding portion 67A and a coil spring 67B. The protruding portion 67A is supported slidably inside the tray main body 66. The protruding portion 67A slides between a position where its distal end is fitted into an engagement hole 67C formed in the inner side surface of the tray housing portion 48 and a position where the distal end is disengaged from the engagement hole 67C. The coil spring 67B is installed between a base provided inside the tray main body 66 and the protruding portion 67A, and urges the protruding portion 67A forward (in the direction to fit into the engagement hole 67C). It is noted that the engagement portion 67 may be provided on the cover 41 (conveyance housing 31), and the engagement hole 67C may be provided in the tray main body 66 (not shown).

(Extension Portion)

As shown in FIG. 2 and FIG. 3, the extension portion 68 is narrower in the front-rear direction than the tray main body 66, and is formed in a rectangular plate shape that can be housed in the tray main body 66. The extension portion 68 is provided slidably on the tray main body 66 (second discharge tray 35). The extension portion 68 is housed inside the tray main body 66 as shown in the lower diagram in FIG. 2, or pulled out from the tray main body 66 and used as a portion extending the document loading surface as shown in the upper diagram (in the frame) in FIG. 2. It is noted that a claw portion is formed on the lower surface of the proximal end portion of the extension portion 68, and a plurality of protrusions engageable with the claw portion are formed on the inner bottom surface of the tray main body 66. By engaging the claw portion with each one of the plurality of protrusions, the pullout amount of the extension portion 68 is adjusted in steps.

(Posture of Second Discharge Tray)

The second discharge tray 35 is provided rotatably between a use posture F1 (see FIG. 2 and FIG. 3) which allows loading of a document sheet on the second discharge tray 35 and a storage posture F2 (see FIG. 4 and FIG. 5) in which the second discharge tray 35 serves as a part of the conveyance housing 31. It is noted that the second discharge tray 35 is placed in the storage posture F2 with the extension portion 68 housed inside the tray main body 66.

(Use Posture)

As shown in FIG. 2 and FIG. 3, when the second discharge tray 35 is in the use posture F1, the linkage portion 65 and the tray main body 66 are in a posture to extend toward the left (outward in the direction opposite to the supply tray 33) from (the left side surface of) the conveyance housing 31, thereby opening the second discharge port 44. Specifically, the second discharge tray 35 in the use posture F1 is inclined obliquely upward from the left side surface of the conveyance housing 31 toward the left. The linkage portion 65 and the tray main body 66 are brought into the form of a single plate, and their upper surfaces become flush with each other to serve as a document loading surface. In addition, the pair of arm portions 66B obliquely extend between the tray main body 66 and the tray housing portion 48, and support the second discharge tray 35 in the use posture F1. It is noted that the extension portion 68 may remain housed in the tray main body 66, or may be pulled out from inside the tray main body 66.

(Storage Posture)

On the other hand, as shown in FIG. 4 and FIG. 5, when the second discharge tray 35 is placed in the storage posture F2, the linkage portion 65 is stacked on the left side surface of the conveyance housing 31 and closes the second discharge port 44, and the tray main body 66 is bent with respect to the linkage portion 65 and stacked on the top surface of the conveyance housing 31. Specifically, the second discharge tray 35 in the storage posture F2 is bent into a substantially L-shape when viewed from the front, and is fitted into the tray housing portion 48 of the cover 41.

More specifically, the linkage portion 65 is rotated around the first rotation shafts 65A to be placed in a substantially vertically standing posture. The linkage portion 65 is fitted into the tray housing portion 48 formed in the left side surface of the cover 41 and closes the second discharge port 44 opened in the cover 41 (conveyance housing 31). The tray main body 66 is rotated around the second rotation shaft 66A with respect to the linkage portion 65 to be placed in a substantially horizontal posture, and is fitted into the tray housing portion 48 formed in the top surface of the cover 41. As the tray main body 66 rotates, the arm portions 66B slide along the slide rails 66C and are housed in the tray housing portion 48 (not shown). In addition, the protruding portion 67A of the engagement portion 67 interferes with the edge (cover 41) of the tray housing portion 48 and is pushed against the urging force of the coil spring 67B, and when the tray main body 66 is fitted into the tray housing portion 48, the protruding portion 67A is urged by the coil spring 67B and is fitted into the engagement hole 67C of the tray housing portion 48 (see the inside of the dashed circle in FIG. 5).

When the second discharge tray 35 is placed in the storage posture F2, the linkage portion 65 and the tray main body 66 become substantially flush with the surface (left side surface and top surface) of the cover 41, and the second discharge tray 35 is integrated with the cover 41 (conveyance housing 31) and becomes a part of the side surface and top surface of the cover 41 (conveyance housing 31). It is noted that, in order to bring the second discharge tray 35 in the storage posture F2 into the use posture F1, the user (operator) may put his/her hand on the handle portion 66D and pull up the tray main body 66. At this time, the protruding portion 67A interferes with the edge of the engagement hole 67C and is pushed against the urging force of the coil spring 67B, and when disengaged from the engagement hole 67C, the protruding portion 67A is urged by the coil spring 67B and protrudes.

By the way, the user places the second discharge tray 35 in the use posture F1 when the user wishes to read an image of a special document sheet such as a card. Therefore, the image reading apparatus 1B (document sheet conveying device 21) according to the present embodiment has a configuration for automatically switching the path for conveying the document sheet when the posture of the second discharge tray 35 is changed from the storage posture F2 to the use posture F1.

<Detection Portion>

As shown in FIG. 2 to FIG. 4, the tray housing portion 48 (conveyance housing 31) is provided with a detection portion 36 that detects the posture of the second discharge tray 35. The detection portion 36 is provided at a position avoiding the second discharge port 44, for example, at a rear top of the tray housing portion 48. The detection portion 36 is a so-called transmissive photosensor, and includes a light emitting portion 36A and a light receiving portion 36B arranged to face each other in the front-rear direction. The detection portion 36 is electrically connected to the control device 7, and transmits a detection signal to the control device 7.

A light blocking piece 37 protrudes from the rear side of the inner surface of the linkage portion 65 of the second discharge tray 35. When the second discharge tray 35 is placed in the storage posture F2 (see FIG. 4), the light blocking piece 37 is inserted between the light emitting portion 36A and the light receiving portion 36B, and blocks light emitted from the light emitting portion 36A (the light receiving portion 36B does not receive the light). When the second discharge tray 35 is placed in the use posture F1 (see FIG. 2 and FIG. 3), the light blocking piece 37 is pulled out from between the light emitting portion 36A and the light receiving portion 36B, and the light receiving portion 36B receives light emitted from the light emitting portion 36A. The detection portion 36 is electrically connected to the control device 7, and transmits a detection signal to the control device 7. The control device 7 receives the detection signal (received or not received), and controls the switching portion 60 (drive source 62) based on the reception result (detection result of the detection portion 36).

[Image Reading Processing]

An operation of the image reading apparatus 1B will be described with reference to FIG. 1, FIG. 2, and FIG. 4. It is noted that, although the document sheets to be loaded on the supply tray 33 are sheet-shaped or card-shaped, the document sheets to be loaded on the platen glass 25B are not limited to sheet-shaped or card-shaped ones, and may be a booklet or the like.

<When Reading Image of Document Sheet on Platen Glass>

First, a case where an image of a document sheet on the platen glass 25B is read will be described with reference to FIG. 1. The user opens the document sheet holding portion 30 to set a document sheet on the platen glass 25B, closes the document sheet holding portion 30, and operates a display input portion such as buttons to provide an instruction (input) for image reading. The control device 7 receives the input and executes image reading processing by controlling various control targets as follows. The laser scanning unit 22 applies light to the document sheet on the platen glass 25B while moving in the right direction. The light reflected by the document sheet is input to the image sensor 24 and converted into an electric signal, whereby the image of the document sheet is read as image data.

<When Reading Image of Document Sheet that can be Curved>

Next, a case where an image of a document sheet that can be curved and is placed on the supply tray 33 is read will be described with reference to FIG. 4. It is noted that the second discharge tray 35 is in the storage posture F2. In addition, the switching portion 60 is placed in a posture for guiding the document sheet from the first conveying path 45 to the second conveying path 46, and connects the first conveying path 45 to the second conveying path 46.

The user sets a document sheet on the supply tray 33 with the document sheet holding portion 30 closed, and operates the display input portion to provide an instruction (input) for image reading. The control device 7 receives the input and executes image reading processing by controlling various control targets as follows.

The pickup roller 50 feeds the document sheet loaded on the supply tray 33 to the first conveying path 45. Even if two or more document sheets are piled up, the document sheets are separated one by one by the separation unit 51 to be sent to the downstream side. The document sheet conveying roller pairs 57 and the like convey the document sheet downstream along the first conveying path 45, and the first reading portion 26 optically reads the image on the back side of the conveyed document sheet.

The document sheet is further conveyed downstream on the first conveying path 45 by the document sheet conveying roller pairs 57, and enters the second conveying path 46 from the first conveying path 45 while being guided by the guide plate 61 of the switching portion 60. The document sheet is conveyed onto the contact glass 25A by the document sheet conveying roller pairs 57. The laser scanning unit 22 applies light to the surface of the document sheet passing over the contact glass 25A, and the light reflected by the document sheet is input to the image sensor 24 and converted into an electric signal.

The document sheet is further conveyed downstream on the second conveying path 46 by the document sheet conveying roller pairs 57. The first discharge roller pair 54 discharges the document sheet conveyed along the second conveying path 46 from the first discharge port 43 toward the first discharge tray 34. The discharged document sheet is loaded on the first discharge tray 34.

The images on both the front and back sides of the document sheet are thereby read as image data.

<When Reading Image of Special Document Sheet>

Next, a case where an image of a special document sheet is read will be described with reference to FIG. 2. The user puts his/her hand on the handle portion 66D to pull up the tray main body 66, and changes (rotates) the posture of the second discharge tray 35 from the storage posture F2 to the use posture F1. Then, the light blocking piece 37 of the linkage portion 65 is pulled out from between the light emitting portion 36A and the light receiving portion 36B of the detection portion 36, and a detection signal indicating that the light receiving portion 36B has received light is sent to the control device 7.

The control device 7 drives (energizes) the drive source 62 of the switching portion 60 based on the detection signal. Then, the guide plate 61 is rotated around the swing shaft 61A to be placed in a posture for guiding the document sheet from the first conveying path 45 to the third conveying path 47, and connects the first conveying path 45 to the third conveying path 47.

The user sets a special document sheet on the supply tray 33 with the document sheet holding portion 30 closed, and operates the display input portion to provide an instruction (input) for image reading. The control device 7 receives the input and executes image reading processing by controlling various control targets as follows. The documents to be set on the supply tray 33 are not limited to special document sheets, and may be documents that can be curved, such as a copy sheet.

The special document sheets loaded on the supply tray 33 are separated one by one and fed to the first conveying path 45 by the pickup roller 50 and the separation unit 51, and the image on the back side is optically read by the first reading portion 26.

The special document sheet is further conveyed downstream on the first conveying path 45 by the document sheet conveying roller pairs 57, and enters the third conveying path 47 from the first conveying path 45 while being guided by the guide plate 61 of the switching portion 60. The second reading portion 27 optically reads an image on the front side of the special document sheet conveyed along the third conveying path 47.

The document sheet is further conveyed downstream on the third conveying path 47 by the document sheet conveying roller pairs 57.

The second discharge roller pair 56 discharges the special document sheet conveyed along the third conveying path 47 from the second discharge port 44 toward the second discharge tray 35. The discharged document sheet is loaded on the second discharge tray 35.

The images on both the front and back sides of the special document sheet are thereby read as image data.

The read image data is stored in the memory of the control device 7, and the control device 7 executes the image forming processing (printing) already described. In addition, the image data may be stored in an external terminal without being printed. It is noted that, although the images on both the front and back sides of the document sheet are read in the image reading processing described above, the first reading portion 26 need not be operated if only the image on the front side of the document sheet is to be read.

It is noted that, even when the second discharge tray 35 is in the use posture F1, the first conveying path 45 can be connected to the second conveying path 46 by the user's operation (input) on the display input portion (touch panel or the like). That is, the control device 7 receives the input from the touch panel or the like, and shut off the energization of the drive source 62. Then, the guide plate 61 is rotated around the swing shaft 61A to be placed in a posture for guiding the document sheet from the first conveying path 45 to the second conveying path 46, and connects the first conveying path 45 to the second conveying path 46.

In addition, when the posture of the second discharge tray 35 is changed from the use posture F1 to the storage posture F2, the light blocking piece 37 is inserted between the light emitting portion 36A and the light receiving portion 36B, and a detection signal indicating that the light is blocked is sent to the control device 7, but the control device 7 continues the current control (energization of the drive source 62). At this time, the control device 7 performs control such as displaying, on the touch panel or the like, an indication (a character string, a pattern, or the like) indicating that the second discharge tray 35 has been housed, or emitting a warning sound from a speaker (not shown). The user confirms the display or the warning sound, and performs an operation (input) on the display input portion (the touch panel or the like) to connect the first conveying path 45 to the second conveying path 46 (switch the path). The control device 7 prohibits the next image reading processing until the switching of the path is completed.

In the document sheet conveying device 21 (image reading apparatus 1B) according to the present embodiment described above, the second discharge tray 35 is supported by the conveyance housing 31 rotatably between the use posture F1 and the storage posture F2. According to this configuration, since the second discharge tray 35 that is not used can be housed (placed in the storage posture F2), space saving (downsizing) of the document sheet conveying device 21 can be achieved (see FIG. 4). In addition, the document sheet conveying device 21 (image reading apparatus 1B) according to the present embodiment has a configuration in which, when the detection portion 36 detects that the posture of the second discharge tray 35 has been changed from the storage posture F2 to the use posture F1 in a state where the first conveying path 45 is connected to the second conveying path 46, the switching portion 60 connects the first conveying path 45 to the third conveying path 47. According to this configuration, by changing the posture of the second discharge tray 35 from the storage posture F2 to the use posture F1, the document sheet can be guided from the first conveying path 45 to the third conveying path 47. In other words, the path along which the document sheet is conveyed can be switched in conjunction with the use of the second discharge tray 35.

In addition, the document sheet conveying device 21 according to the present embodiment has a configuration in which the second discharge tray 35 in the storage posture F2 closes the second discharge port 44 and is stacked on the side surface and top surface of the conveyance housing 31. According to this configuration, the conveyance housing 31 (document sheet conveying device 21) can be downsized without significantly changing the shape (design) of the conveyance housing 31 by the second discharge tray 35 placed in the storage posture F2 (see FIG. 4). In addition, since the linkage portion 65 stacked on the side surface of the conveyance housing 31 and the tray main body 66 stacked on the top surface of the conveyance housing 31 are extended to form a single second discharge tray 35, the document sheet loading surface can be easily widened as compared with, for example, a tray that is stacked only on the side surface of the conveyance housing 31 (see FIG. 3). Thus, even a large document sheet can be reliably received on the loading surface.

In addition, according to the document sheet conveying device 21 of the present embodiment, even a large document sheet can be reliably received by extending the extension portion 68 as necessary.

[Modifications]

The document sheet conveying device 21 (image reading apparatus 1B) according to the present embodiment has a configuration in which the control device 7 continues the current control even when the posture of the second discharge tray 35 is changed from the use posture F1 to the storage posture F2, but the present disclosure is not limited to this. In a document sheet conveying device 21 (image reading apparatus 1B) according to a modification, when the detection portion 36 detects that the posture of the second discharge tray 35 has been changed from the use posture F1 to the storage posture F2 in a state where the first conveying path 45 is connected to the third conveying path 47, the switching portion 60 may connect the first conveying path 45 to the second conveying path 46. That is, when the second discharge tray 35 is placed in the storage posture F2 and the light blocking piece 37 is inserted between the light emitting portion 36A and the light receiving portion 36B, the control device 7 receives a detection signal indicating that the light is blocked, and shuts off the energization of the drive source 62. Then, the guide plate 61 is rotated around the swing shaft 61A to be placed in a posture for guiding the document sheet from the first conveying path 45 to the second conveying path 46, and connects the first conveying path 45 to the second conveying path 46 (see FIG. 4).

According to the document sheet conveying device 21 (image reading apparatus 1B) of the modification of the present embodiment, by changing the posture of the second discharge tray 35 from the use posture F1 to the storage posture F2, the first conveying path 45 connected to the third conveying path 47 can be switched to be connected to the second conveying path 46. In other words, the path can be switched in conjunction with the end of use of the second discharge tray 35.

Figure 6:
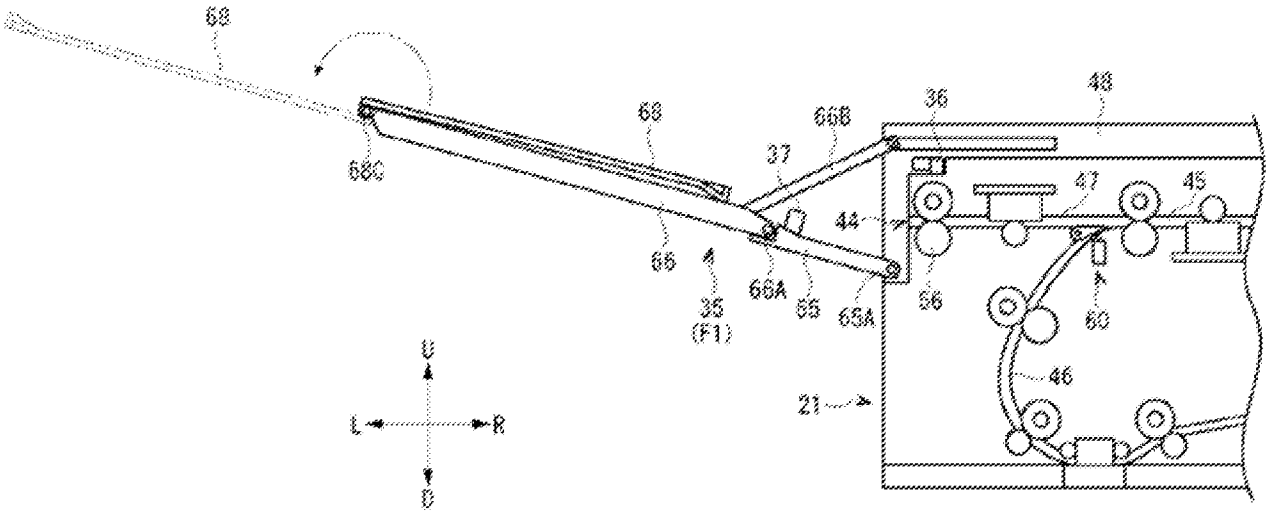
FIG. 6 is a front view showing a second discharge tray of a document sheet conveying device according to another modification of an embodiment of the present disclosure.

In the document sheet conveying device 21 according to the present embodiment (including the modification), the extension portion 68 is provided slidably on the second discharge tray 35, but the present disclosure is not limited to this. In a document sheet conveying device 21 according to another modification, for example, as shown in FIG. 6, the extension portion 68 may be rotatably connected to the second discharge tray 35 (the distal end portion of the tray main body 66) via an extension shaft 68C. In this case, the extension portion 68 is folded back and stacked on the tray main body 66 (see the solid line in FIG. 6), or is expanded for use (see the dash-dot-dot-dash line in FIG. 6).

Figure 7:
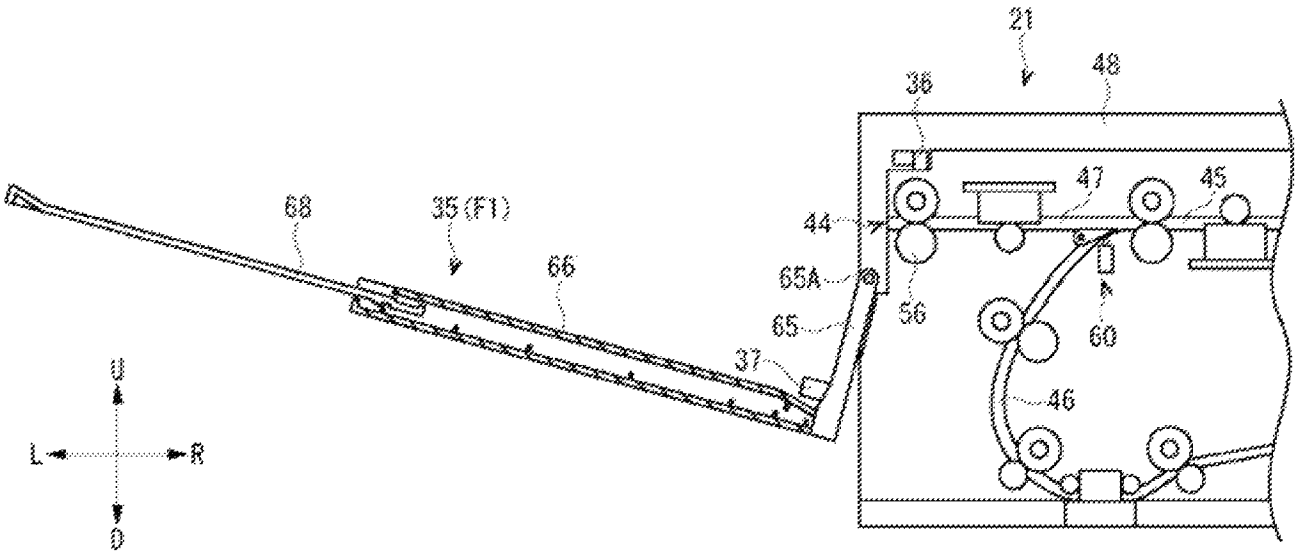
FIG. 7 is a front view showing a second discharge tray of a document sheet conveying device according to another modification of an embodiment of the present disclosure.

In addition, although the tray main body 66 is rotatably connected to the linkage portion 65 in the document sheet conveying device 21 according to the present embodiment (including the modifications), the present disclosure is not limited to this. In a document sheet conveying device 21 according to another modification, for example, as shown in FIG. 7, the linkage portion 65 and the tray main body 66 may be integrally formed so as to form a substantially L-shape when viewed from the front. In this case, the arm portions 66B or the like may be omitted, and an inclined surface that brings the linkage portion 65 into surface contact with the left side surface of the cover 41 may be formed.

Although the drive source 62 of the switching portion 60 is a solenoid in the document sheet conveying device 21 according to the present embodiment (including the modifications; the same applies hereinafter), the drive source 62 is not limited to this, and may be, for example, a motor that rotates a cam in contact with the guide plate 61, or a motor that rotates the guide plate 61 while controlling the rotation angle of the guide plate 61 (both are not shown).

In addition, although the cover 41 is provided with the handle portion 66D in the document sheet conveying device 21 according to the present embodiment, the tray main body 66 may be provided with a rotatable lever (not shown) instead of the handle portion 66D. When this lever is pulled, the protruding portion 67A may be disengaged from the engagement hole 67C in conjunction therewith (not shown). Alternatively, the handle portion 66D may be omitted (not shown).

In addition, the image reading apparatus 1B according to the present embodiment has a configuration in which the image sensor 24 and the first and second reading portions 26 and 27 for reading the images of a document sheet conveyed along the first to third conveying paths 45 to 47 are provided, and the images of both the front and back sides of the document sheet are read, but the present disclosure is not limited to this. For example, if the image reading apparatus 1B is designed to read only the image on the front side of the document sheet, the first reading portion 26 may be omitted. That is, the image reading apparatus 1B should have at least the image sensor 24 and the second reading portion 27 for reading the image of the document sheet conveyed through the second conveying path 46 and the third conveying path 47.

In addition, the image forming apparatus 1A according to the present embodiment is a monochrome printer, but the image forming apparatus 1A is not limited thereto, and may be a color printer, a copying machine, a facsimile machine, or the like. In addition, although the image forming apparatus 1A employs the electrophotographic method, the image forming method may be an inkjet method.

It is noted that the description of the above-described embodiment shows one aspect in the document sheet conveying device, image reading apparatus, and multifunction peripheral according to the present disclosure, and the technical scope of the present disclosure is not limited to the above-described embodiment. The present disclosure may be changed, substituted, or modified in various ways without departing from the spirit of the technical idea, and the claims include all embodiments that may be included within the scope of the technical idea.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A document sheet conveying device comprising:

a supply tray that extends outward from a conveyance housing;

a first discharge tray that faces the supply tray in a vertical direction;

a second discharge tray provided on an opposite side of the supply tray across the conveyance housing and configured to rotate between a use posture which allows loading of a document sheet on the second discharge tray and a storage posture in which the second discharge tray serves as a part of the conveyance housing;

a detection portion configured to detect a posture of the second discharge tray;

a first conveying path formed linearly from the supply tray to a branch point inside the conveyance housing;

a second conveying path formed in a U-shape from the branch point to the first discharge tray;

a third conveying path formed linearly from the branch point to the second discharge tray;

a switching portion provided at the branch point and configured to connect the first conveying path to one of the second conveying path and the third conveying path;

a control device configured to control the switching portion; and a display input portion, wherein the control device controls the switching portion to connect the first conveying path to the third conveying path when the detection portion detects that the second discharge tray is in the use posture in a state where the first conveying path is connected to the second conveying path, the control device controls the switching portion to connect the first conveying path to the second conveying path when an instruction to connect the first conveying path to the second conveying path is received through a user operation on the display input portion in a state where the first conveying path is connected to the third conveying path, and the control device prohibits, when the second discharge tray is in the storage posture in the state where the first conveying path is connected to the third conveying path, the conveyance of the document sheet from the supply tray until the first conveying path is connected to the second conveying path or the second discharge tray changes the posture from the storage posture to the use posture.

2. The document sheet conveying device according to claim 1, wherein the control device controls the switching portion to connect the first conveying path to the second conveying path when the detection portion detects that the second discharge tray is in the storage posture in the state where the first conveying path is connected to the third conveying path.

3. The document sheet conveying device according to claim 1, wherein the second discharge tray includes a linkage portion rotatable around a first rotation axis provided on a side surface of the conveyance housing and extending in a direction orthogonal to the first rotation axis, and a tray main body provided at an extending end of the linkage portion and rotatable around a second rotation axis parallel to the first rotation axis, a discharge port configured to discharge the document sheet conveyed along the third conveying path to the second discharge tray is formed in the side surface of the conveyance housing, the second discharge tray in the use posture extends outward from the conveyance housing in a direction opposite to the supply tray and opens the discharge port, and the second discharge tray in the storage posture has the linkage portion close the discharge port and has the tray main body form an L-shape with the linkage portion, and is stacked on a top surface of the conveyance housing.

4. The document sheet conveying device according to claim 3, wherein the second discharge tray is provided with an extension portion rotatably or slidably supported by the tray main body and extends a loading surface of the document sheet.

5. The document sheet conveying device according to claim 1, wherein a discharge port configured to discharge the document sheet conveyed along the third conveying path to the second discharge tray is formed in a side surface of the conveyance housing, the second discharge tray includes:

a linkage portion rotatably connected to the conveyance housing; and a tray main body rotatably connected to a distal end of the linkage portion, when the second discharge tray is placed in the use posture, the linkage portion and the tray main body extend outward from the conveyance housing in a direction opposite to the supply tray and open the discharge port, when the second discharge tray is placed in the storage posture, the linkage portion is stacked on the side surface of the conveyance housing and closes the discharge port, and when the second discharge tray is placed in the storage posture, the tray main body bends with respect to the linkage portion and is stacked on a top surface of the conveyance housing.

6. An image reading apparatus comprising:

the document sheet conveying device according to claim 1;

a first reading portion disposed on the second conveying path and configured to read an image on a first side of the document sheet conveyed along the second conveying path; and a second reading portion disposed on the third conveying path and configured to read the image on the first side of the document sheet conveyed along the third conveying path.

7. A multifunction peripheral comprising:

the image reading apparatus according to claim 6; and an image forming apparatus configured to form the image of the document sheet read by the image reading apparatus on a medium.

8. The document sheet conveying device according to claim 1, wherein the second discharge tray includes:

a linkage portion rotatably connected to the conveyance housing, the linkage portion including a light blocking piece protruding from a surface of the linkage portion and engageable with the detection portion for detecting the posture of the second discharge tray.

* * * * *